US011723504B2

(12) United States Patent
Hwang et al.

(10) Patent No.: US 11,723,504 B2
(45) Date of Patent: Aug. 15, 2023

(54) CLEANER

(71) Applicant: LG Electronics Inc., Seoul (KR)

(72) Inventors: Philjae Hwang, Seoul (KR); Eunji Sung, Seoul (KR); Taekgi Lee, Seoul (KR); Mantae Hwang, Seoul (KR); Jungbae Hwang, Seoul (MN)

(73) Assignee: LG Electronics Inc., Seoul (KR)

( * ) Notice: Subject to any disclaimer, the term of this patent is extended or adjusted under 35 U.S.C. 154(b) by 298 days.

(21) Appl. No.: 16/922,496

(22) Filed: Jul. 7, 2020

(65) Prior Publication Data

US 2020/0329936 A1 Oct. 22, 2020

Related U.S. Application Data

(63) Continuation of application No. 15/654,002, filed on Jul. 19, 2017, now Pat. No. 10,842,336.

(51) Int. Cl.

| | |
|---|---|
| ***A47L 9/28*** | (2006.01) |
| ***A47L 5/24*** | (2006.01) |
| ***A47L 9/16*** | (2006.01) |
| ***A47L 9/24*** | (2006.01) |
| ***A47L 9/30*** | (2006.01) |
| ***A47L 9/32*** | (2006.01) |

(52) U.S. Cl.

CPC ..... *A47L 9/2884* (2013.01); *A47L 5/24* (2013.01); *A47L 9/1691* (2013.01); *A47L 9/244* (2013.01); *A47L 9/30* (2013.01); *A47L 9/322* (2013.01)

(58) Field of Classification Search

CPC ..... A47L 5/14; A47L 5/24; A47L 5/26; A47L 9/10; A47L 9/1683; A47L 9/1691; A47L 9/22; A47L 9/24; A47L 9/244; A47L 9/28; A47L 9/2884; A47L 9/30; A47L 9/32; A47L 9/322; A47L 7/0038; A47L 7/0042

See application file for complete search history.

(56) References Cited

U.S. PATENT DOCUMENTS 5,644,815 A * 7/1997 Bosyj ..... A47L 9/0009 15/328
5,661,873 A 9/1997 Karet
6,428,589 B1 8/2002 Bair et al.
(Continued)

FOREIGN PATENT DOCUMENTS

KR 10-0546629 1/2006
KR 10-2006-0122247 11/2006
(Continued)

OTHER PUBLICATIONS

AU Examination Report in Australian Appln. No. 2019279935, dated Dec. 9, 2020, 6 pages.
(Continued)

*Primary Examiner* — Robert J Scruggs
(74) *Attorney, Agent, or Firm* — Fish & Richardson P.C.

(57) ABSTRACT

A cleaner includes: a suction unit; a main body that is connected with the suction unit and separates dust from air sucked through the suction unit; and a handle unit that is connected to the main body, wherein the main body includes: a first body and a second body; a sealing member for sealing a boundary between the first body and the second body; and a support body that supports the sealing member and has an opening that communicates with the suction unit.

11 Claims, 15 Drawing Sheets

(56) References Cited

U.S. PATENT DOCUMENTS

| | | | | |
|---|---|---|---|---|
| 6,618,898 | B2 * | 9/2003 | Tingle | A01K 1/01 15/352 |
| 2007/0199284 | A1 | 8/2007 | Yoo et al. | |
| 2009/0229071 | A1 | 9/2009 | Fester et al. | |
| 2009/0265877 | A1 | 10/2009 | Dyson et al. | |
| 2010/0005617 | A1 | 1/2010 | Hyun et al. | |
| 2013/0160233 | A1 | 6/2013 | Peace et al. | |
| 2014/0196248 | A1 | 7/2014 | Morgan et al. | |
| 2014/0237755 | A1 | 8/2014 | Comad | |
| 2016/0015227 | A1 | 1/2016 | Conrad et al. | |
| 2016/0113467 | A1 | 4/2016 | Box et al. | |

FOREIGN PATENT DOCUMENTS

| | | |
|---|---|---|
| KR | 20060122247 | * 11/2006 |
| KR | 10-1026774 | 4/2011 |
| KR | 2012-024112 | 2/2012 |
| KR | 10-1127088 | 3/2012 |
| KR | 10-2016-0015237 | 2/2016 |
| KR | 10-2016-0034041 | 3/2016 |

OTHER PUBLICATIONS

Office Action in Korean Appln. No. 10-2016-0108316, dated Mar. 20, 2023, 15 pages (with English translation).

* cited by examiner

CLEANER

CROSS-REFERENCE TO RELATED APPLICATIONS

This application is a continuation of U.S. application Ser. No. 15/654,002, filed on Jul. 19, 2017, which claims priority under 35 U.S.C. § 119 to Korean Patent Application No. 10-2016-0108316, filed in Korea on Aug. 25, 2016. The disclosures of the prior applications are incorporated by reference in their entirety.

BACKGROUND

The present disclosure relates to a cleaner.

Cleaners may be classified into a manual cleaner that a user moves in person for cleaning and an automatic cleaner that automatically moves for cleaning.

Manual cleaners may fall into, depending on the types, a canister cleaner, an upright cleaner, a handy cleaner, and a stick cleaner.

Handy cleaners, generally, may include a suction unit, a body, and a handle.

Meanwhile, in the related art, a handheld vacuum cleaner has been disclosed in Korean Patent No. 10-1127088 (registered on 8 Mar. 2012).

The handheld vacuum cleaner includes a suction pipe, an airflow generator, a cyclone, a power supply, and a handle.

The cyclone is disposed between the handle and the suction pipe, the airflow generator is disposed right over the handle, and the power supply is disposed right under the handle. Accordingly, the airflow generator and the power supply are disposed behind the cyclone.

The airflow generator and the power supply are relatively heavy parts of the components.

According to this document, since the relatively heavy airflow generator and power supply are disposed right over and under the handle, respectively, the center of gravity concentrates on the handle in the entire handheld vacuum cleaner, so it is inconvenient for a user to use the handheld vacuum cleaner and the user's wrist may be injured.

Further, according to the document, since the airflow generator is disposed behind the cyclone, the channel for guiding air from the cyclone to the airflow generator is necessarily long and the air discharged from the cyclone is sent to the airflow generator with the flow direction changed, which causes a large flow loss.

Further, according to the document, since the airflow generator is disposed right over the handle, the air discharged from the airflow generator directly touches the hand holding the handle.

SUMMARY

The present disclosure provides a cleaner that users can more conveniently use by distributing the overall weight.

The present disclosure provides a cleaner in which a first body providing a storage space and a second body receiving a suction motor have simple structures because the bodies are separately manufactured.

The present disclosure provides a cleaner in which sealing can be maintained when a first body and a second body are combined.

The present disclosure provides a cleaner that has improve aesthetic appearance because a sealing member for sealing a first body and a second body is exposed to the outside.

The present disclosure provides a cleaner in which a sealing member exposed outside is not separated.

A cleaner includes: a suction unit; a main body that is connected with the suction unit and separates dust from air sucked through the suction unit; and a handle unit that is connected to the main body, in which the main body includes: a first body and a second body; a sealing member for sealing a boundary between the first body and the second body; and a support body that supports the sealing member and has an opening that communicates with the suction unit.

A cleaner include: a support body that has an opening; a first body that is slide-coupled to the support body from under the support body; a second body that is slide-coupled to the support body from above the support body; and a suction unit that is coupled to one or more of the first body and the second body in a direction crossing the direction in which the first body and the second body are slide-coupled to the support body, and communicates with the opening.

A cleaner includes: a first body; a second body that is connected with the first body; and a pipe that is connected to any one of the first body and the second body while covering a portion of a boundary between the first body and the second body to guide air and dust.

DETAILED DESCRIPTION OF THE EMBODIMENTS

Figure 1:
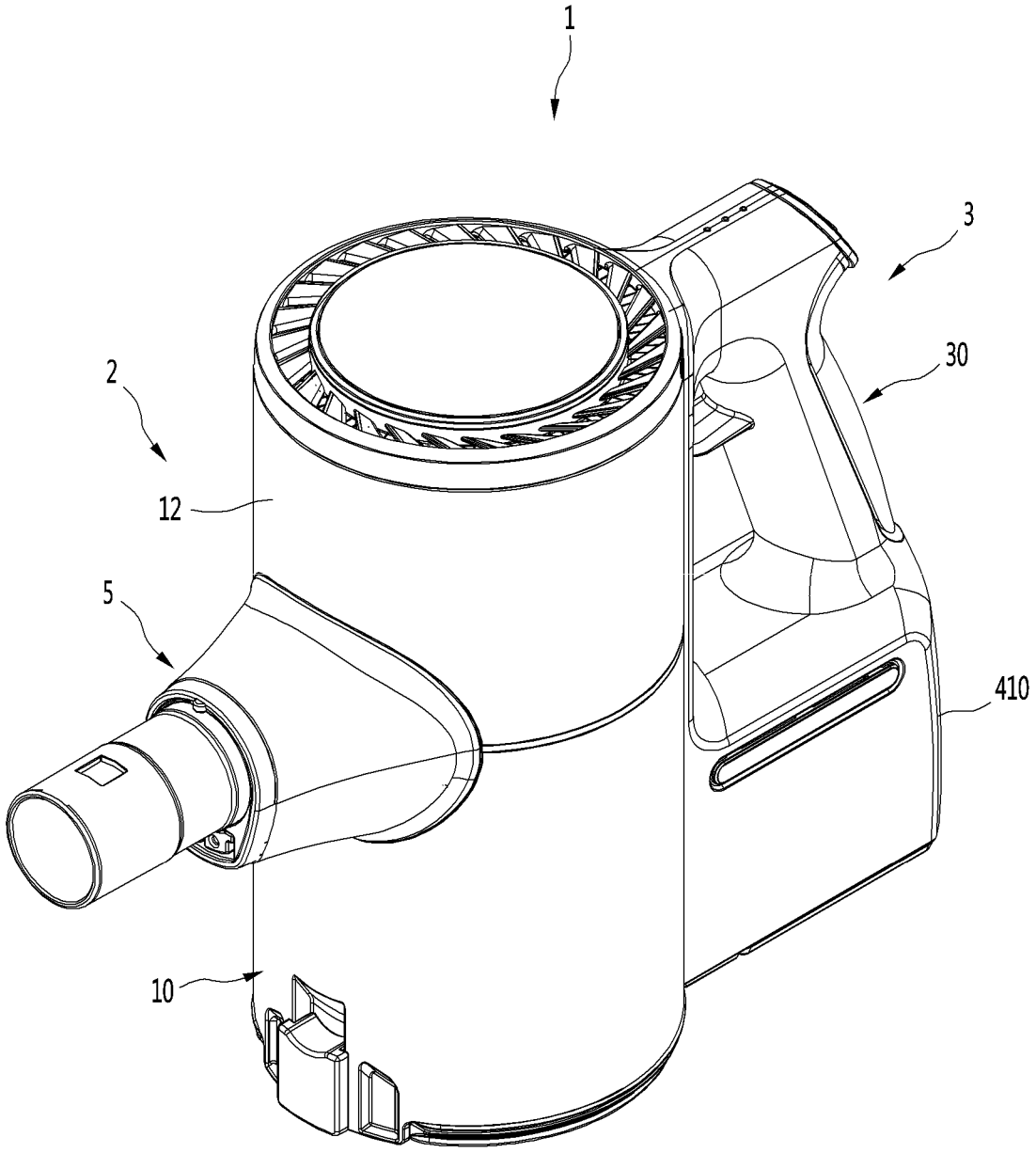
FIG. 1 is a perspective view of a cleaner according to an embodiment of the present invention.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

Figure 2:
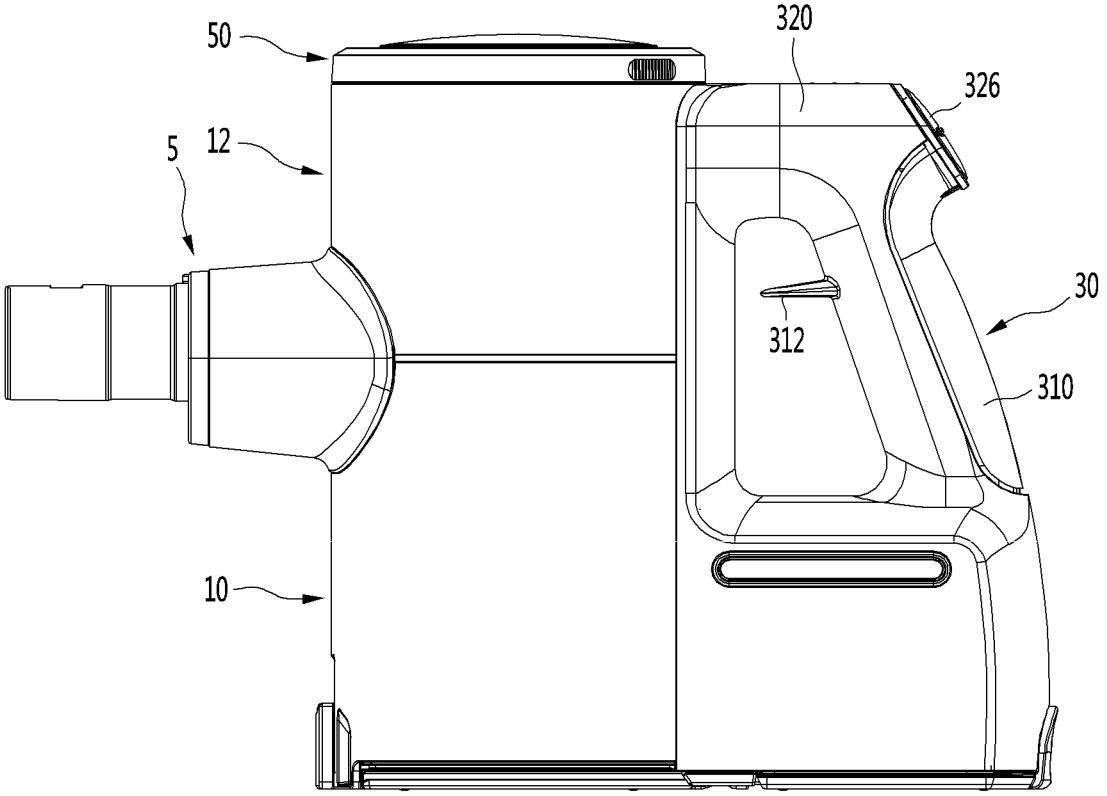
FIG. 2 is a side view of the cleaner according to an embodiment of the present invention.
Figure 3:
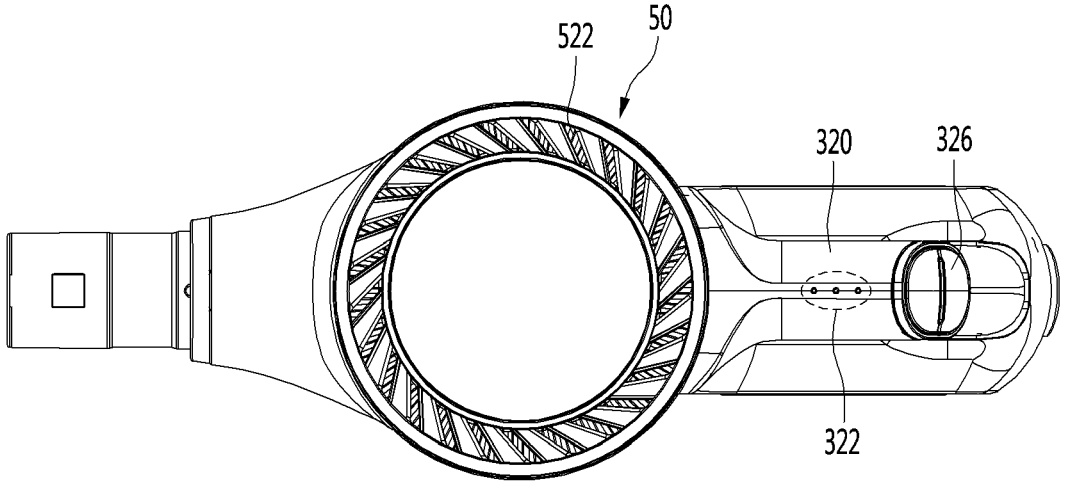
FIG. 3 is a plan view of the cleaner according to an embodiment of the present invention.
Figure 4:
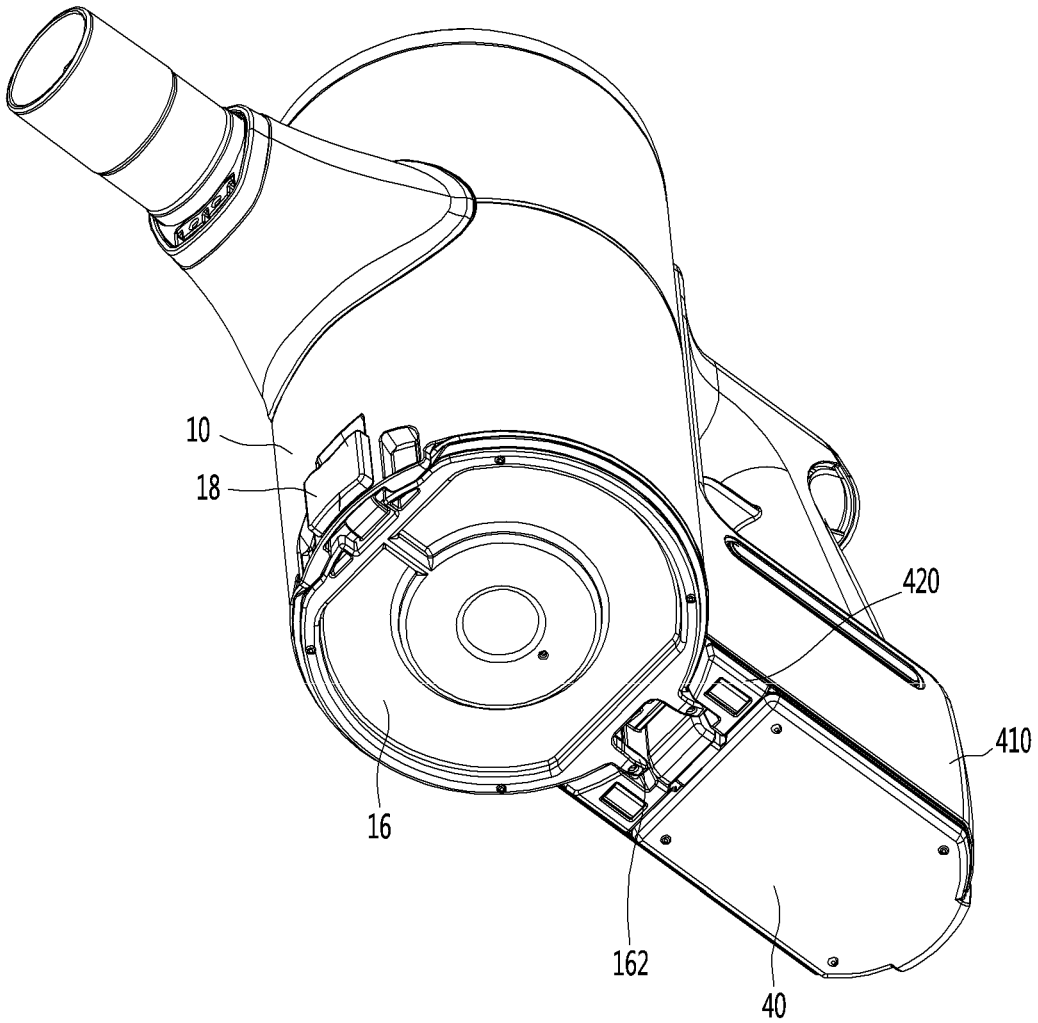
FIG. 4 is a perspective view of the cleaner according to an embodiment of the present invention when seen from under the cleaner.
Figure 5:
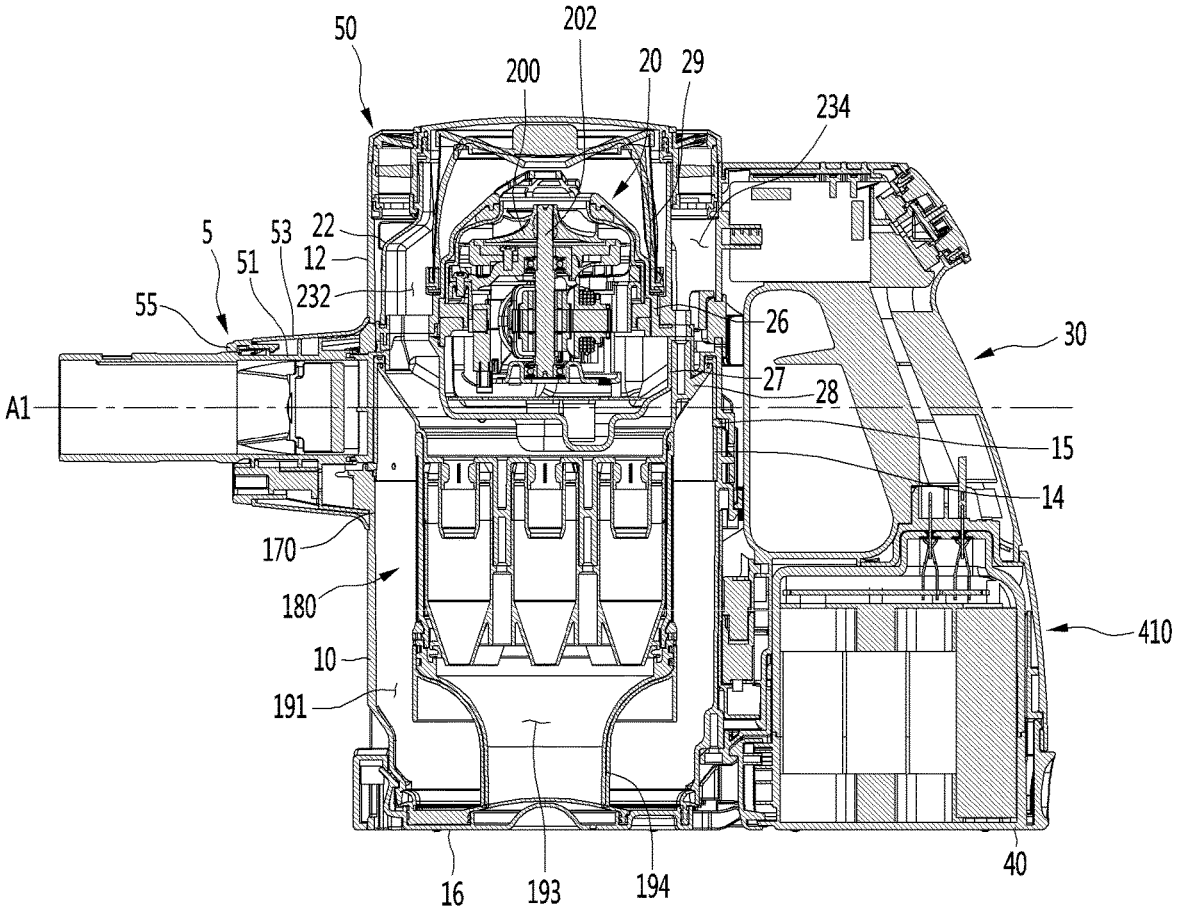
FIG. 5 is a cross-sectional view of the cleaner according to an embodiment of the present invention.

FIG. 1 is a perspective view of a cleaner according to an embodiment of the present invention, FIG. 2 is a side view of the cleaner according to an embodiment of the present invention, FIG. 3 is a plan view of the cleaner according to an embodiment of the present invention, FIG. 4 is a perspective view of the cleaner according to an embodiment of the present invention when seen from under the cleaner, and FIG. 5 is a cross-sectional view of the cleaner according to an embodiment of the present invention.

Referring to FIGS. 1 to 5, a cleaner 1 according to an embodiment of the present invention may include a main body 2.

The cleaner 1 may further include a suction unit 5 coupled to the front of the main body 2. The suction unit 5 can guide air containing dust into the main body 2.

The cleaner 1 may further include a handle unit 3 coupled to the main body 2. The handle unit 3 may be positioned opposite to the suction unit 5 on the main body 2.

That is, the main body 2 may be disposed between the suction unit 5 and the handle unit 3.

The main body 2 may include a first body 10 and a second body 12 on the first body 10.

The first body 10 and the second body 12 may be, though not limited thereto, formed in a cylindrical shape.

The suction unit 5 may be coupled to the main body 2 such that the center of the suction unit 5 is positioned approximately at the boundary between the first body 10 and the second body 12.

The main body 2 may further include a dust separation unit that separates dust from air sucked through the suction unit 5.

The dust separation unit may include a first cyclone unit 170 that can separate dust, for example, using cyclonic flow. The first body 10 includes the first cyclone unit 170 in this configuration.

The air and dust sucked through the suction unit 5 helically flow along the inner side of the first cyclone unit 170.

The axis of the cyclonic flow in the first cyclone unit 170 may vertically extend.

The dust separation unit may further include a second cyclone unit 180 that secondarily separates dust from the air discharged out of the first cyclone unit 170. The second cyclone unit 180 may be disposed inside the first cyclone unit 170 to minimize the size of the dust separation unit. The second cyclone unit 180 may include a plurality of cyclone bodies arranged in a raw.

As another example, the dust separation unit may include one cyclone unit, in which the axis of the cyclonic flow may also vertically extend.

The first body 10 functions as a dust container that stores dust separated by the cyclone units 170 and 180.

The main body 2 may further include a body cover 16 for opening/closing the bottom of the first body 10. The body cover 16 can open/close the first body 10 by being rotated.

At least a portion of the second cyclone unit 180 may be positioned inside the first body 10.

A dust storage guide 194 that guides the dust separated by the second cyclone unit 180 to be stored may be disposed in the first body 10. The dust storage guide 194 may be coupled to the bottom of the second cyclone unit 180 in contact with the top of the body cover 16.

The dust storage guide 194 may divide the internal space of the first body 10 into a first dust storage part 191 where the dust separated by the first cyclone unit 170 is stored and a second dust storage part 193 where the dust separated by the second cyclone unit 190 is stored.

The internal space of the dust storage guide 194 is the second dust storage part 193 and the space between the dust storage guide 194 and the first body 10 is the first dust storage part 191.

The body cover 16 can open/close both of the first dust storage part 191 and the second dust storage part 193.

The cleaner 1 may further include a suction motor 20 for generating suction force and a battery 40 for supplying power to the suction motor 20.

The suction motor 20 may be disposed in the second body 12. At least a portion of the suction motor 20 may be disposed over the dust separation unit. Accordingly, the suction motor 20 is disposed over the first body 10.

The suction motor 20 may communicate with an outlet of the second cyclone unit 180.

To this end, the main body 2 may further include a discharge guide 28 connected to the second cyclone unit 180 and a flow guide 22 that communicates with the discharge guide 28.

For example, the discharge guide 28 is disposed on the second cyclone unit 190 and the flow guide 22 is disposed over the discharge guide 28.

Further, at least a portion of the suction motor 20 is positioned inside the flow guide 22.

Accordingly, the axis of the dust separation unit may pass through the suction motor 20.

When the suction motor 20 is disposed over the second cyclone unit 180, the air discharged from the second cyclone unit 180 can flow directly to the suction motor 20, so the channel between the dust separation unit and the suction motor 20 can be minimized.

The suction motor 20 may include a rotary impeller 200. The impeller 200 may be fitted on a shaft 202. The shaft 202 is vertically disposed.

An extension line from the shaft 202 (which may be considered as the rotational axis of the impeller 200) may pass through the first body 10. The rotational axis of the impeller 200 and the axis of the cyclonic flow in the first cyclone unit 170 may be on the same line.

According to the present invention, there is the advantage that the path through which the air discharged from the dust separation unit, that is, the air discharged upward from the second cyclone unit 180 flows to the suction motor 20 can be reduced and a change in direction of air can be decreased, so a loss of airflow can be reduced.

As the loss of airflow is reduced, suction force can be increased and the lifetime of the battery 40 for supplying power to the suction motor 20 can be increased.

The cleaner 1 may further include an upper motor housing 26 covering a portion of the top of the suction motor 20 and a lower motor housing 27 covering a portion of the bottom of the suction motor 20.

The suction motor 20 may be disposed inside the motor housings 26 and 27 and the flow guide 22 may be disposed to cover the upper motor housing 26.

At least a portion of the flow guide 22 may be spaced apart from the upper motor housing 26. Further, at least a portion of the flow guide 22 may be spaced apart from the second body 12.

Accordingly, a first air passage 232 is defined by the inner side of the flow guide 22 and the outer side of the upper motor housing 26 and a second air passage 234 is defined by the outer side of the flow guide 22 and the inner side of the second body 12.

The air discharged from the second cyclone unit 190 flows to the suction motor 20 through the first air passage 232 and the air discharged from the suction motor 20 flows through the second air passage 234 and is then discharged outside. Accordingly, the second air passage 234 functions as an exhaust channel.

The handle unit 3 may include a handle 30 for a user to hold and a battery housing 410 under the handle 30.

The handle 30 may be disposed behind the suction motor 20.

As for directions, with respect to the suction motor 20 in the cleaner 1, the direction in which the suction unit 5 is positioned is the front direction and the direction in which the handle 30 is positioned is the rear direction.

The battery 40 may be disposed behind the first body 10. Accordingly, the suction motor 20 and the battery 40 may be arranged not to vertically overlap each other and may be disposed at different heights.

According to the present invention, since the suction motor 20 that is heavy is disposed ahead of the handle 30 and the battery 40 that is heavy is disposed behind the handle 30, so weight can be uniformly distributed throughout the cleaner 1. It is possible to prevent injuries to the user's wrist when a user cleans with the handle 30 in his/her hand. That is, since the heavy components are distributed at the front and rear portions and at different heights in the cleaner 1, it is possible to prevent the center of gravity of the cleaner 1 from concentrating on any one side.

Since the battery 40 is disposed under the handle 30 and the suction motor 20 is disposed in front of the handle 30, there is no component over the handle 30. That is, the top of the handle 30 forms a portion of the external appearance of the top of the cleaner 1.

Accordingly, it is possible to prevent any component of the cleaner 1 from coming in contact with the user's arm while the user cleans with the handle 30 in his/her hand.

The handle 30 may include a first extension 310 extending vertically to be held by a user and a second extension 320 extending toward the suction motor 20 over the first extension 310. The second extension 320 may at least partially horizontally extend.

A stopper 312 for preventing a user's hand holding the first extension 310 from moving in the longitudinal direction of the first extension 310 (vertically in FIG. 2) may be formed on the first extension 310. The stopper 312 may extend toward the suction unit 5 from the first extension 310.

The stopper 312 is spaced apart from the second extension 320. Accordingly, a user is supposed to hold the first extension 310, with some of the fingers over the stopper 312 and the other fingers under the stopper 312.

For example, the stopper 312 may be positioned between the index finger and the middle finger.

According to this arrangement, when a user holds the first extension 310, the longitudinal axis A1 of the suction unit 5 may pass through the user's wrist.

When the longitudinal axis A1 of the suction unit 5 passes through the user's wrist and the user's arm is stretched, the longitudinal axis A1 of the suction unit 5 may be substantially aligned with the user's stretched arm. Accordingly, there is the advantage in this state that the user uses minimum force when pushing or pulling the cleaner 1 with the handle 30 in his/her hand.

The handle 30 may include an operation unit 326. For example, the operation unit 326 may be disposed on an inclined surface of the second extension 320. It is possible to input instructions to turn on/off the cleaner (suction motor) through the operation unit 390.

The operation unit 326 may be disposed to face a user. The operation unit 390 may be disposed opposite to the stopper 312 with the handle 30 therebetween.

The operation unit 326 is positioned higher than the stopper 312. Accordingly, a user can easily operate the operation unit 326 with his/her thumb with the first extension 310 in his/her hand.

Further, since the operation unit 326 is positioned outside the first extension 310, it is possible to prevent the operation unit 326 from being unexpectedly operated when a user cleans with the first extension 310 in his/her hand.

A display unit 322 for showing operational states may be disposed on the second extension 320. The display unit 322 may be, for example, disposed on the top of the second extension 320. Accordingly, a user can easily check the display unit 322 on the top of the second extension 320 while cleaning. The display 322, for example, can show the remaining capacity of the battery 40 and the intensity of the suction motor 20.

The display unit 322, though not limited, may include a plurality of light emitting units. The light emitting units may be spaced from each other in the longitudinal direction of the second extension 320.

The battery housing 410 may be disposed under the first extension 310.

The battery 40 may be detachably combined with the battery housing 410. For example, the battery 40 may be inserted into the battery housing 410 from under the battery housing 60.

The rear side of the battery housing 410 and the rear side of the first extension 310 may form a continuous surface. Accordingly, the battery housing 410 and the first extension 310 can be shown like a single unit.

Referring to FIG. 3, the cleaner 1 may further include a filter unit 50 having air exits 522 for discharging the air that has passed through the suction motor 20. For example, the air exits 522 may include a plurality of openings and the openings may be circumferentially arranged.

The filter unit 50 may be detachably coupled to the top of the main body 2. The filter unit 50 may be detachably inserted in the second body 12.

When the filter unit 50 is combined with the main body 2, a portion of the filter unit 50 is positioned outside the second body 12. Accordingly, a portion of the filter unit 50 is inserted in the main body 2 through the open top of the main body 2 and the other portion protrudes outside from the main body 2.

The height of the main body 2 may be substantially the same as the height of the handle 30. Accordingly, the filter unit 50 protrudes upward from the main body 2, so a user can easily hold and separate the filter unit 50.

When the filter unit 50 is combined with the main body 2, the air exits 522 are positioned at the upper portion of the filter unit 50. Accordingly, the air discharged from the suction motor 20 is discharged upward from the main body 2.

According to this embodiment, it is possible to prevent the air discharged from the air exits 522 from flowing to a user while the user cleans using the cleaner 1.

The main body 2 may further include a pre-filter 29 for filtering the air flowing into the suction motor 20. The pre-filter 29 may be disposed inside the flow guide 22. Further, the pre-filter 29 is seated over the upper motor housing 16 and may surround a portion of the upper motor housing 26. That is, the upper motor housing 26 may include a filter support for supporting the pre-filter 29.

Figure 6:
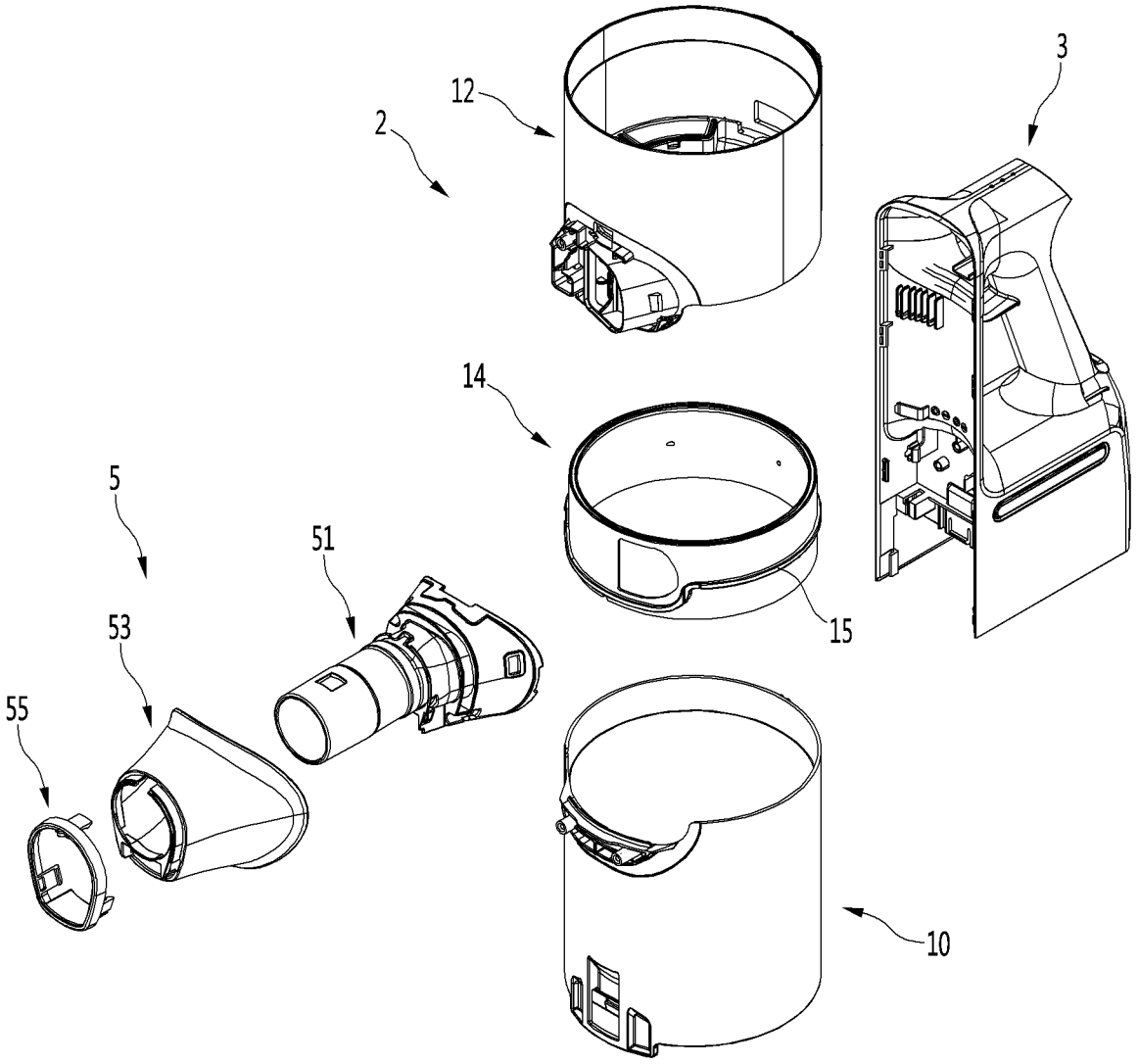
FIG. 6 is an exploded perspective view of the cleaner according to an embodiment of the present invention.
Figure 7:
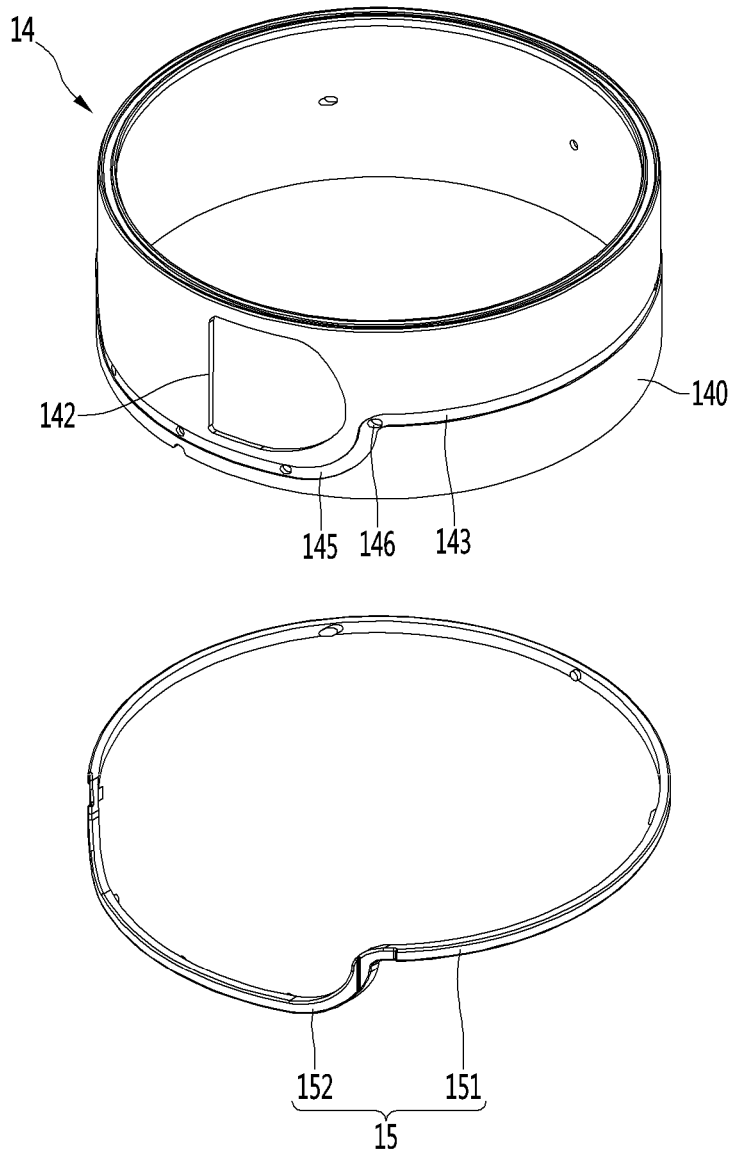
FIG. 7 is a view showing a support body and a sealing member according to an embodiment of the present invention.

FIG. 6 is an exploded perspective view of the cleaner according to an embodiment of the present invention and FIG. 7 is a view showing a support body and a sealing member according to an embodiment of the present invention.

Referring to FIGS. 5 to 7, the main body 2 may be disposed between the suction unit 5 and the handle unit 3. The first body 10 and the second body 12 may be, for example, vertically arranged.

The cleaner 1 may further include a sealing member 15 and a support body 14 supporting the sealing member 15 to seal the boundary between the first body 10 and the second body 12 that have been combined.

The first body 10 and the second body 12 may be open at the top and the bottom, respectively. That is, the bodies 10 and 12 may include a top opening and a bottom opening, respectively.

The first body 10 may be slide-coupled to the support body 14 from under the support body 14. The second body 12 may be slide-coupled to the support body 14 from above the support body 14.

The support body 14 may be formed in a cylindrical shape. The outer diameter of the support body 14 may be made the same as or smaller than the inner diameter of the first body 10 so that the support body 14 can be inserted into the first body 10 through the top opening of the first body 10.

Further, the outer diameter of the support body 14 may be made the same as or smaller than the inner diameter of the second body 12 so that the support body 14 can be inserted into the second body 12 through the bottom opening of the second body 12.

The support body 14 may include an opening 142.

The sealing member 15 may be fitted around the support body 14. The sealing member 15 may surround the support body 14. For example, the sealing member 15 may be integrally formed with the support body 14 through injection molding. Alternatively, the sealing member 15 may be attached to the outer side of the support body 14 through an adhesive.

The support body 14 may include a first seating groove 143 extending around the support body 14 and a second seating groove 145 extending from the first seating groove 143 at a different height from the first seating groove 143.

The sealing member 15 can be seated in the seating grooves 143 and 145.

The first seating groove 143 may be formed at a position that approximately bisects the height of the support body 14. The second seating groove 145 bypasses the opening 142. For example, the second seating groove 145 is positioned under the opening 142.

Accordingly, the sealing member 15 may include a first section 151 that is seated in the first seating groove 143 and a second section 152 that continues from the first section 151 and is seated in the second seating groove 145.

When the sealing member 15 is seated in the seating grooves 143 and 145, a portion of the sealing member 15 may protrude from the support body 14. Since the sealing member 15 fitted on the support body 14 protrudes from the support body 14, the sealing member 15 can be positioned at the boundary between the first body 10 and the second body 12 even though the support body 14 is inserted in the first body 10 and the second body 12, whereby sealing is possible.

Fixing holes 146 where portions of the sealing member 15 are positioned are formed in the seating grooves 143 and 145. As portions of the sealing member 15 are inserted in the fixing holes 146, the sealing member 15 can be prevented from rotating circumferentially around the support body 14.

The suction unit 5 may include a connection pipe 51 that is connected to the main body 2, a pipe cover 53 that covers the connection pipe 51, and a cover deco-member 55 that surrounds a portion of the pipe cover 53 to be coupled to the connection pipe 51.

Figure 8:
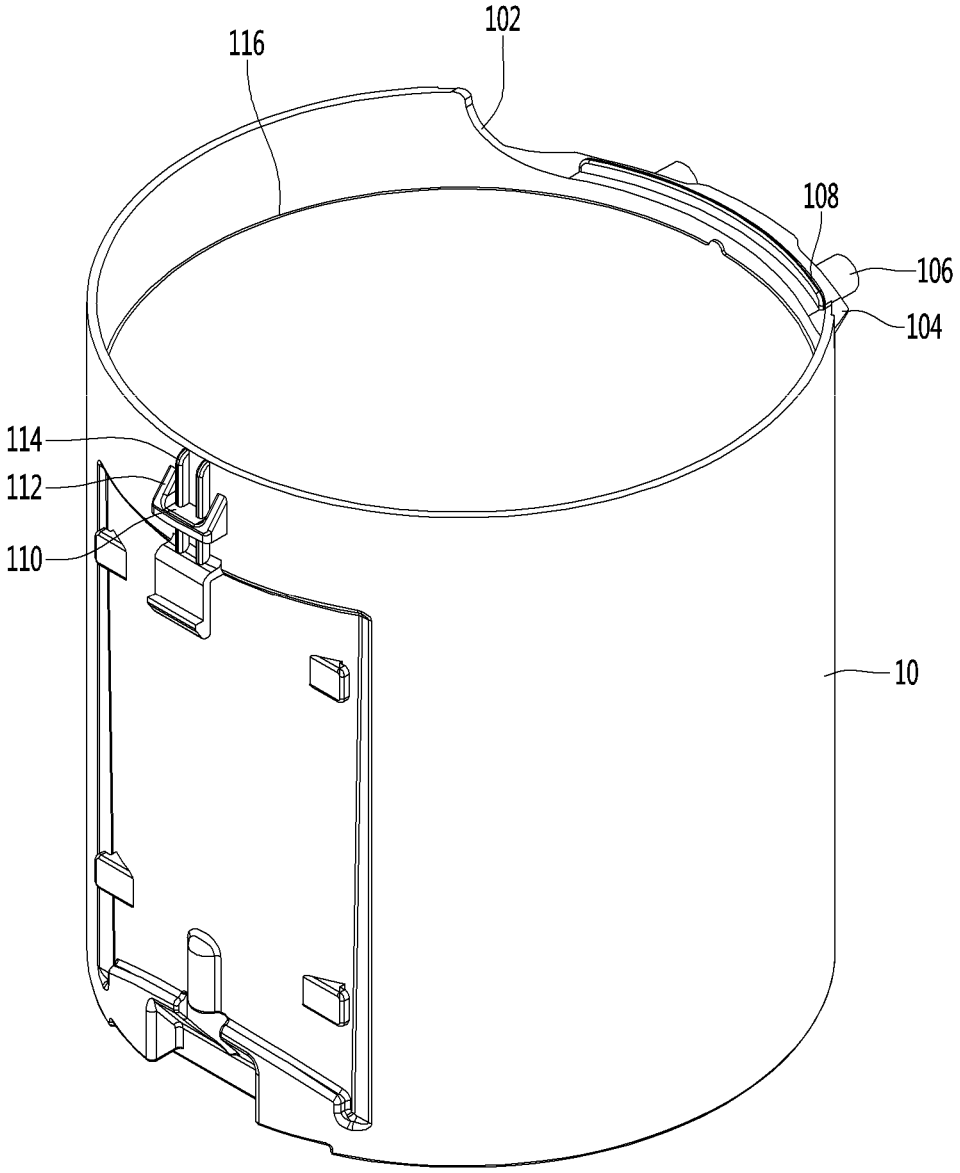
FIG. 8 is a perspective view of a first body according to an embodiment of the present invention.
Figure 9:
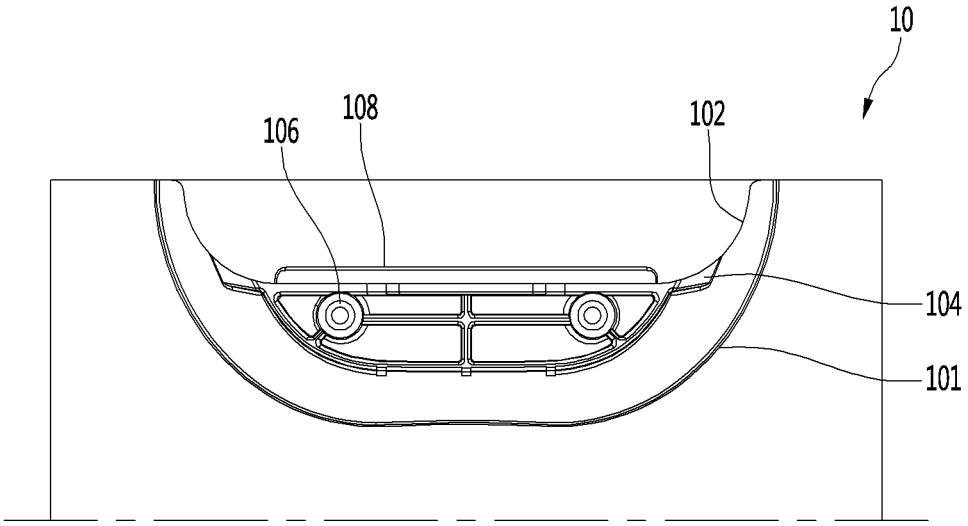
FIG. 9 is a front view of the first body shown in FIG. 8.

FIG. 8 is a perspective view of the first body according to an embodiment of the present invention and FIG. 9 is a front view of the first body shown in FIG. 8.

Referring to FIGS. 8 and 9, a first recession 101 that is recessed inward may be formed at the upper portion of the first body 10.

A receiving part 102 that provides a space for holding a portion of the second body 12 may be formed at the first recession 101.

The receiving part 102 may be formed by cutting downward the upper end of the first body 10.

The first body 10 may further include a pipe coupling portion 104 (or a suction unit coupling portion) for coupling the connection pipe 51. The pipe coupling portion 104 may protrude from the first body 10 under the receiving part 102.

The pipe coupling portion 104 may include one or more main body fastening bosses 106 to which fasteners are coupled.

The sealing member 15 may be seated on the receiving part 102. In detail, the second section 152 of the sealing member 15 may be seated on the receiving part 102.

A stopper rib 108 that prevents the second section 152 seated on the receiving part 102 from moving away from the support body 14 may be disposed on the top of the pipe coupling portion 104. Since the second section 152 of the sealing member 15 is rounded, the stopper rib 108 may be rounded to come in contact with the second section 152 of the sealing member 15.

Accordingly, the first section 151 of the sealing member 15 can be seated on the upper end of the first body 10 and the second section 152 of the sealing member 15 can be seated on the body receiving part 112.

The pipe coupling portion 104 on the first recession 101 may be covered by the connection pipe 51.

The first body 10 may further include a first coupling portion 110 to be combined with the second body 12.

The first coupling portion 110 may protrude from the outer side of the first body 10 and the top of the first coupling portion 110 may be inclined downward for easy combination with the second body 12.

The first coupling portion 110 may be disposed at a predetermined distance downward from the upper end of the first body 10. The first body 10 may have one or more reinforcing ribs 114 for preventing damage to the first coupling portion 110.

A seat 116 for supporting the lower end of the support body 14 inserted in the first body 10 may be formed on the inner side of the first body 10. For example, the seat 116 may be a step formed by a change in thickness of the first body 10.

Figure 10:
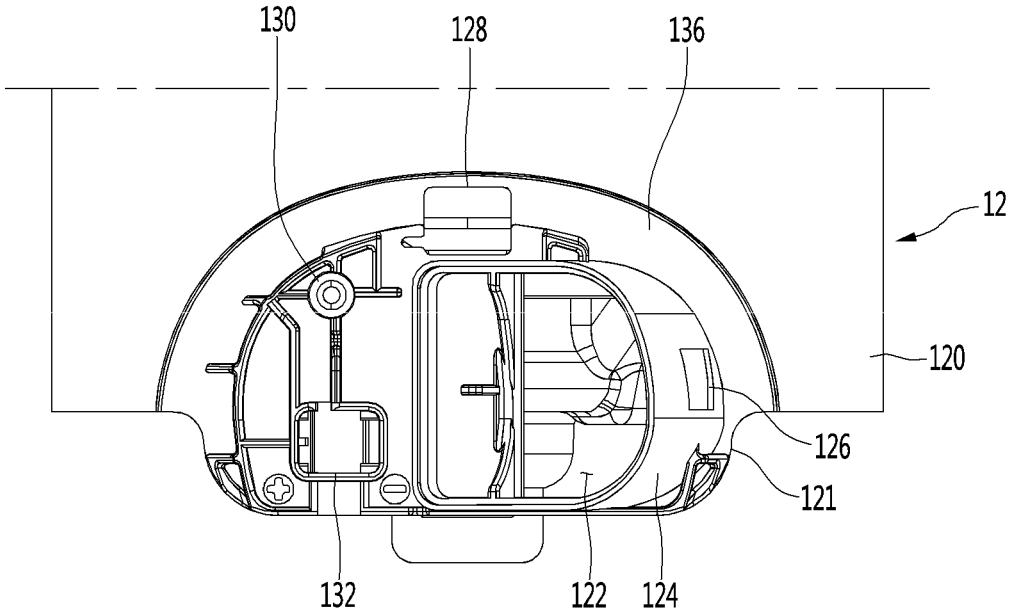
FIG. 10 is a front view of a second body according to an embodiment of the present invention.
Figure 11:
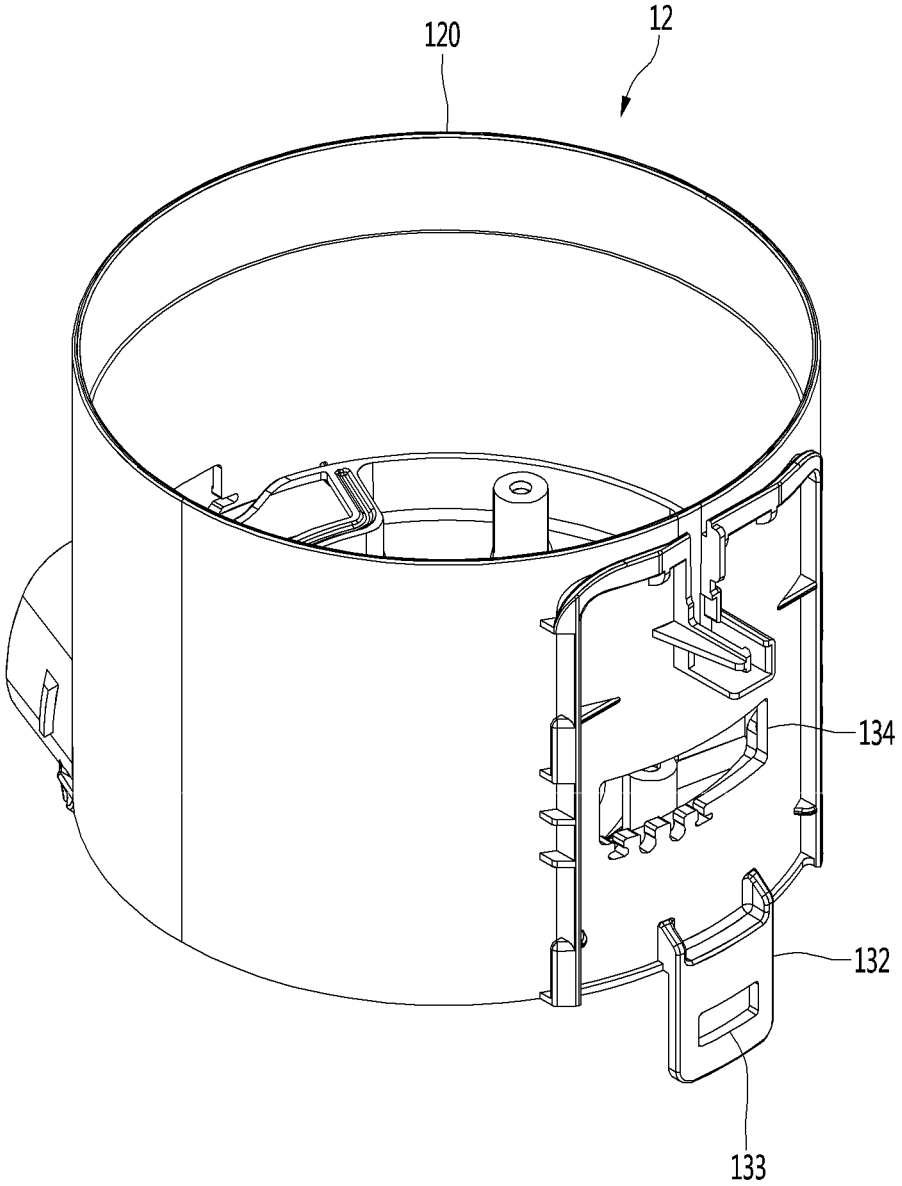
FIG. 11 is a perspective view of the second body according to an embodiment of the present invention.

FIG. 10 is a front view of the second body according to an embodiment of the present invention. FIG. 11 is a perspective view of the second body according to an embodiment of the present invention.

Referring to FIGS. 10 and 11, the second body 12 may include a cylindrical part 120. A second recession 136 that is recessed inward may be formed at a lower portion of the cylindrical part 120.

The second body 12 may further include an extension 121 that extends downward from the lower end of the second recession 136 of the cylindrical part 120.

The extension 121 may be formed in a shape corresponding to the receiving part 102 of the first body 10. The extension 121 may be positioned on the receiving part 102 of the first body 10 and seated on the second section 152 of the sealing member 15.

The second body 12 may include a suction opening 122 through which the air guided through the suction unit 5 flows inside.

The suction opening 122 may be formed at the cylindrical part 120 and the extension 121 inside the recession 136.

The reason that the extension 121 extends downward from the cylindrical part 120 and a portion of the suction opening 122 is formed at the extension 121 is for positioning the suction unit 5 around the middle of the height of the main body 2 without a large difference in height between the first body 10 and the second body 12.

According to this structure, the longitudinal axis A1 of the suction unit 5 can be positioned between the suction motor 20 and the second cyclone unit 180.

If the longitudinal axis A1 of the suction unit 5 passes through the suction motor 20, there is a need for a channel for guiding air to the first cyclone unit 170 around the suction motor 20 and the diameter of the main body 2 is accordingly increased.

However, the lower the longitudinal axis A1 of the suction unit 5, the smaller the height of the first cyclone unit 170, so the ability to separate dust is deteriorated.

Therefore, according to the present invention, since the longitudinal axis A1 of the suction unit 5 is positioned between the suction motor 20 and the second cyclone unit 180, it is possible to maintain the ability to separate dust and prevent the diameter or the size of the main body 2 from increasing.

The second body 12 may further include a suction guide 124 for guiding air to the suction opening 122. The suction guide 124 may tangentially protrude from the second body 12.

A locking protrusion 126 for locking the connection pipe 51 may be formed on the suction guide 124.

Further, the second body 12 may include a main body fastening boss 130 for fastening the pipe 51 using a fastener.

Further, the second body 12 may include a terminal mount 132 for mounting a terminal for electrical connection with the connection pipe 51 and a wire hole 128 through which a main body wire passes. The wire hole 128 may be covered with a packing (not shown) and the main body wire may pass through the packing.

When the connection pipe 51 is coupled to the main body fastening boss 130, the suction opening 122, the suction guide 124, the main body fastening boss 130, the terminal mount 132, and the wire hole 128 inside the second recession 136 are covered with the connection pipe 51.

The second body 12 may further include a second coupling portion 132 extending downward from the second body 12 on the opposite side to the suction opening 122.

A coupling hole 133 in which the first coupling portion 110 of the first body 10 is inserted may be formed on the second coupling portion 132.

Further, the second body 12 may include a wire hole 134 through which a main body wire for supplying power to the suction motor 20 passes. The wire hole 134 may be covered with a packing and the main body wire may pass through the packing.

Figure 12:
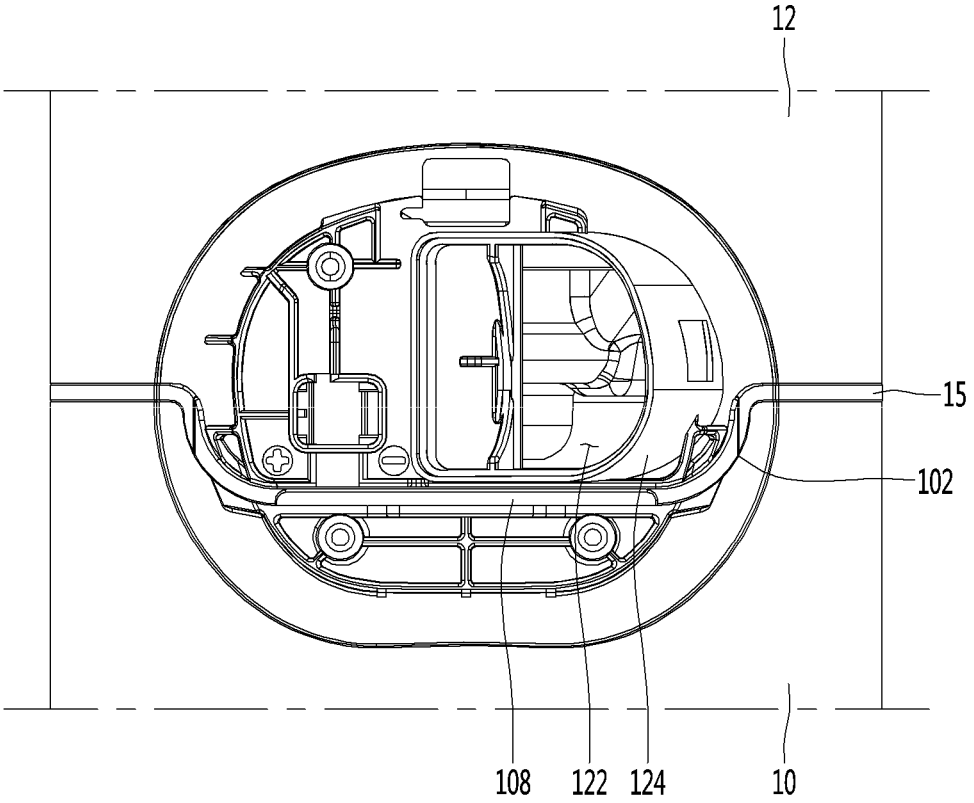
FIG. 12 is a front view of a main body formed by combining the first body and the second body with each other.
Figure 13:
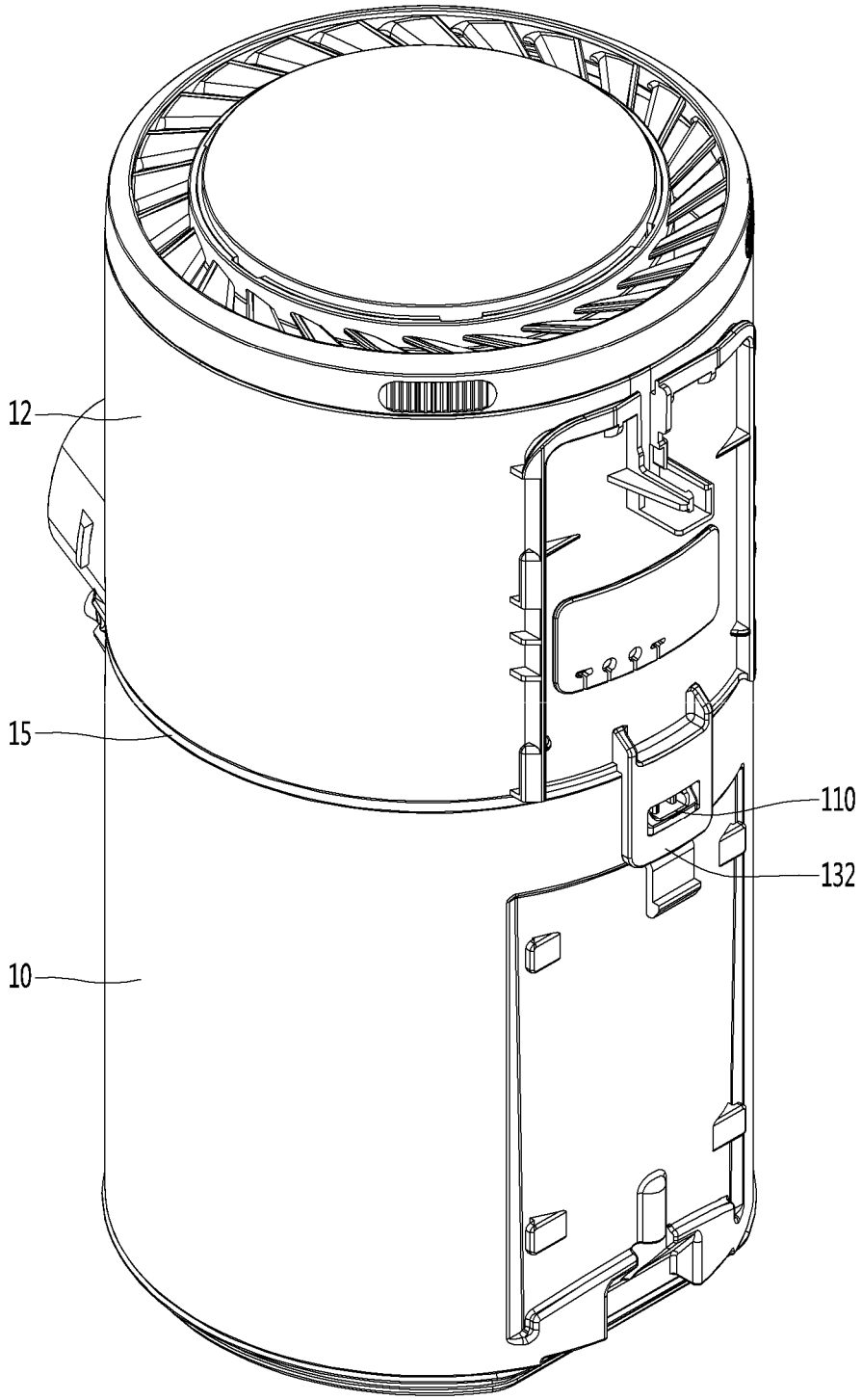
FIG. 13 is a rear perspective view of the main body formed by combining the first body and the second body with each other.

FIG. 12 is a front view of the main body formed by combining the first body and the second body with each other and FIG. 13 is a rear perspective view of the main body formed by combining the first body and the second body with each other.

Referring to FIGS. 6 to 13, in a stated in which the sealing member 15 combined with the support body 14, a lower portion of the support body 14 that is disposed under the sealing member 15 can be inserted into the first body 10.

Accordingly, the first section 151 of the sealing member 15 is seated on the upper end of the first body 10 and the second section 152 of the sealing member 15 is seated on the receiving part 102 of the first body 10.

Then, the second body 12 is coupled to the first body 10 from above the first body 10.

Accordingly, a portion of the support body 14 that is disposed above the sealing member 15 is inserted in the second body 12 and the second coupling portion 132 of the second body 12 is coupled to the first coupling portion 110 of the first body 10. Further, the lower end of the second body 12 is seated on the sealing member 15. When the second body 12 is coupled to the first body 10, the second body 12 and the first body 10 press the sealing member 15.

When the second coupling portion 132 is coupled to the first coupling portion 105, the second coupling portion 132 is positioned outside the sealing member 15. Accordingly, it is possible to prevent a portion of the sealing member 15 from separating outward from the support body 14.

Further, when the second body 12 is coupled to the first body 10, the suction opening 122 of the second body 12 and the opening 142 of the support body 14 are aligned.

Further, the suction unit 5 may be coupled to one or more of the first body 10 and the second body in a direction crossing the direction in which the first body 10 and the second body 12 are slide-coupled to the support body 14. In this configuration, the suction unit 5 may communicate with the opening 142 of the support body 14. For example, after the first body 10 and the second body 12 are combined, the suction unit 5 can be coupled to both of the first body 10 and the second body 12.

According to this embodiment, since the first body 10 that provides a storage space and the second body 12 that receives the suction motor 20 are separately manufactured and then combined with each other, the structures of the bodies can be simple.

Further, according to the present invention, since the sealing member 15 is disposed at the boundary between the first body 10 and the second body 12 when the first body 10 and the second body 12 are combined, sealing can be maintained.

Figure 14:
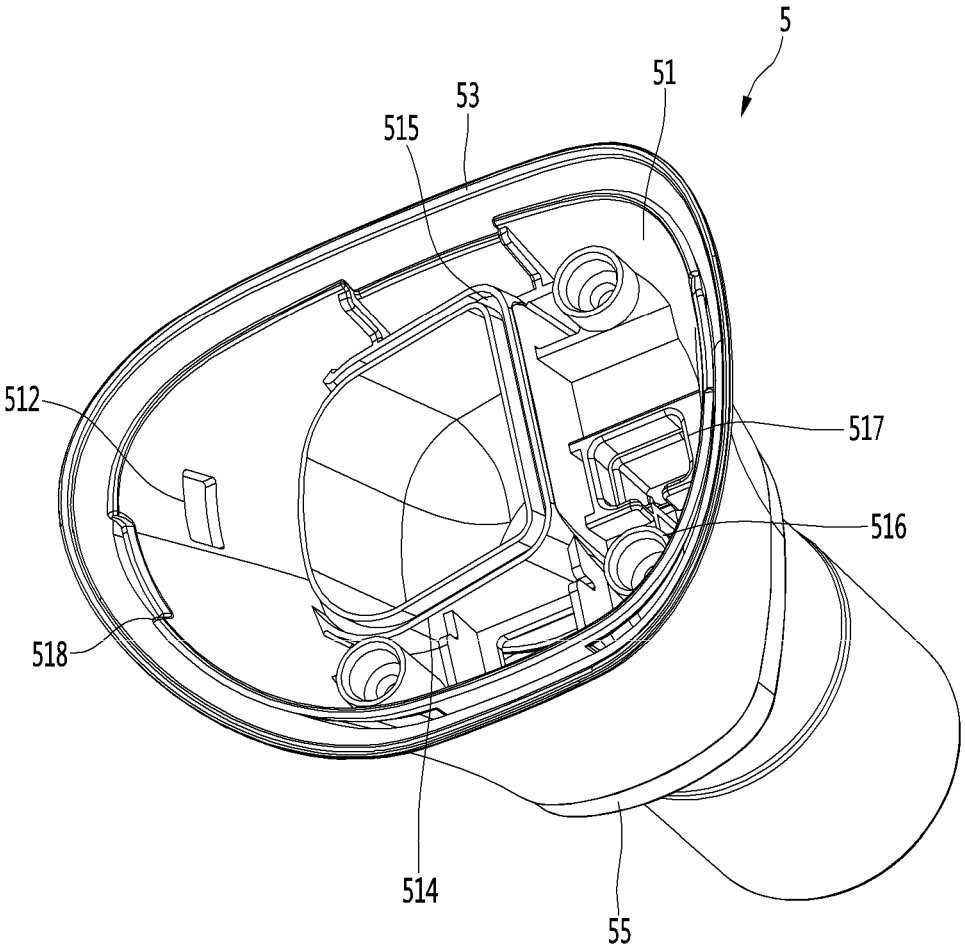
FIG. 14 is a perspective view of a suction unit according to an embodiment of the present invention.
Figure 15:
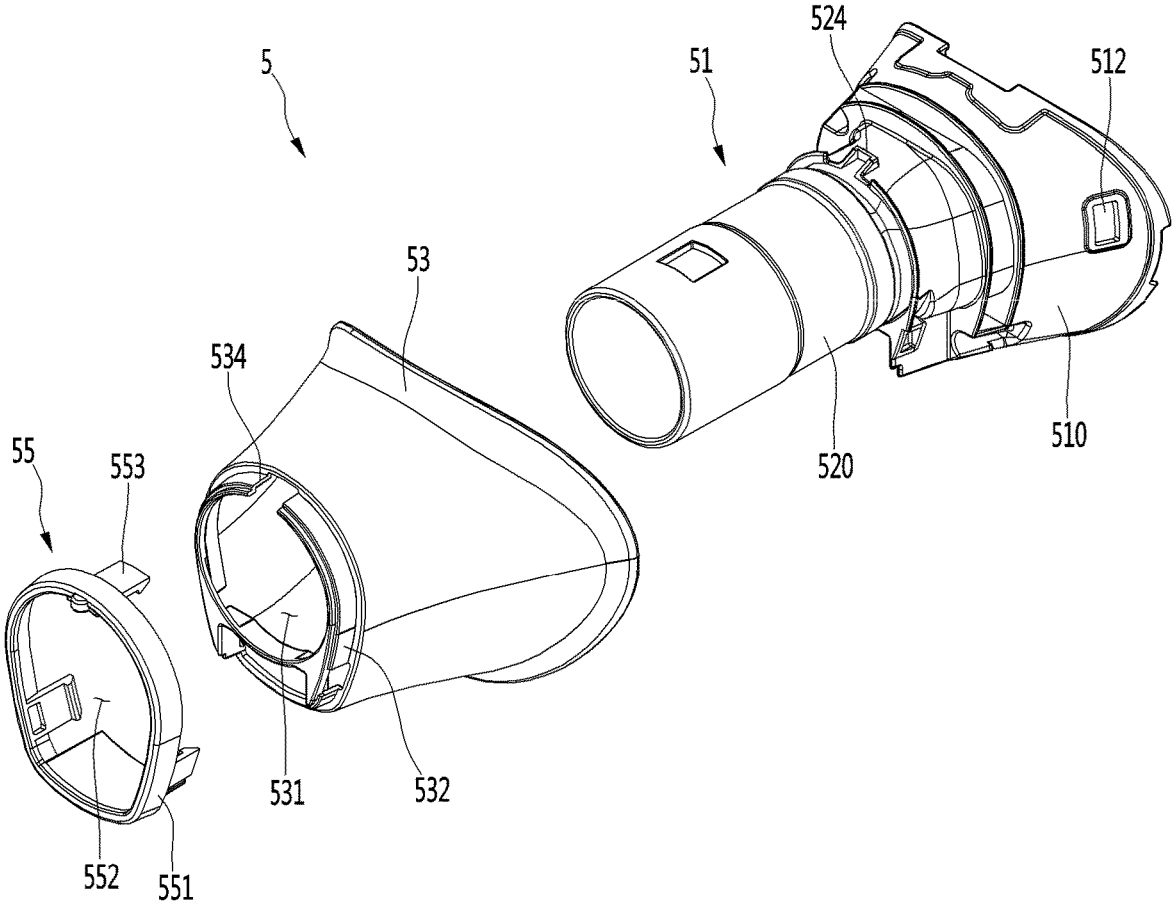
FIG. 15 is an exploded perspective view of the suction unit according to an embodiment of the present invention.

FIG. 14 is a perspective view of the suction unit according to an embodiment of the present invention, FIG. 15 is an exploded perspective view of the suction unit according to an embodiment of the present invention, and FIG. 16 is a view when the suction unit of the present invention is coupled to the main body.

Referring to FIGS. 6 to 15, the connection pipe 51 may include a main body connecting portion 510 to be coupled to the main body 2 and a guide pipe 520 extending from the main body connecting portion 510 to guide air to the main body 2.

Though not shown in the guide pipe 520, an extension pipe connected to a suction nozzle can be coupled to the guide pipe. Alternatively, a suction nozzle may be coupled directly to the guide pipe 520.

The main body connecting portion 510 may include a terminal mount 517 for mounting a terminal for electrical connection with the main body 2.

The main body connecting portion 510 may further include pipe fastening bosses 516 for coupling to the main body fastening bosses 106 and 130 of the bodies 10 and 12.

The main body connecting portion 510 may further include a locking hole 512 for locking the locking protrusion 126 of the suction guide 124.

In order to couple the connection pipe 51 to the main body 2, first, the connection pipe 51 is placed ahead of the main body 2 and then horizontally moved such that the locking protrusion 126 is locked into the locking hole 512 of the main body connecting portion 510. Accordingly, the suction guide 124 is inserted into the insertion groove 515 of the suction duct 514, and the main body fastening bosses 106 and 130 and the pipe fastening bosses 516 can be aligned.

The connection pipe 51 can be fixed to the main body 2 by coupling fasteners to the fastening bosses 516 and the main body fastening bosses 106 and 130 from ahead of the pipe 51.

An anti-interference groove 518 may be formed on the connection pipe 51 to prevent interference between the connection pipe 51 and the second section 152 of the sealing member 15, with the connection pipe 51 fixed to the main body 2.

The pipe cover 53 may be placed in position to cover the connection pipe 51 after the pipe 51 is coupled to the main body 2.

The pipe cover 53 may include a hole 531 for passing the guide pipe 520. A mounting portion 532 for mounting the cover deco-member 55 is formed around the hole 531 of the pipe cover 53. Further, slots 534 for passing the hooks 553 of the cover deco-member 55 may be formed at the mounting portion 532.

The cover deco-member 55 may include a body 551 with a hole 552 for passing the guide pipe 520 and the hooks 553 extending from the body 551.

When the cover deco-member 55 is fitted on the mounting portion 532 with the connection pipe 51 covered by the pipe cover 53, the hooks 553 of the cover deco-member 55 are locked to hook locking protrusions 524 of the guide pipe 520.

When the cover deco-member 55 is fitted on the pipe 51, the edge of the pipe cover 53 comes in contact with the end of the first recession 101 of the first body 10 and the second recession 136 of the second body 12.

With the connection pipe 51 covered with the pipe cover 53, the first section 151 of the sealing member 15 is exposed to the outside, while the second section 152 is not exposed to the outside. That is, the suction unit 5 covers a portion of the boundary between the bodies 10 and 12.

According to the present invention, since the suction motor is disposed over the dust separation unit and the handle is disposed behind the suction motor, the whole weight of the cleaner is distributed, so a user can more conveniently use the cleaner.

Further, since the first body that provides a storage space and the second body that receives the suction motor are separately manufactured and then combined with each other, the structures of the bodies can be simple.

Further, according to the present invention, since the sealing member is provided at the first body and the second body that are combined with each other, sealing can be maintained.

Further, since the sealing member is formed in a ring shape, the first body and the second body are in contact with each other along the entire circumference, sealing can be improved.

Further, according to the present invention, since the sealing member for sealing the first body and the second body is exposed to the outside, the aesthetic appearance of the product can be improved.

Further, according to the present invention, it is possible to prevent the sealing member from separating from the main body even though the sealing member is exposed to the outside.

What is claimed is:

1. A cleaner comprising:

a suction unit configured to receive air and dust from an outside of the cleaner;

a main body that is connected to the suction unit and configured to separate the dust from the air received through the suction unit; and a handle unit connected to the main body, wherein the main body is disposed between the suction unit and the handle unit and comprises:

a suction motor configured to generate suction force for causing the air and dust to be received through the suction unit, a cyclone unit configured to separate the dust from the air received through the suction unit, a first body that receives the cyclone unit, and a second body that is connected to an upper portion of the first body and receives the suction motor, wherein the suction unit comprises a pipe that is connected to the first body or to the second body and configured to guide the air and dust to the first body, and wherein the pipe covers a portion of a boundary between the first body and the second body.

2. The cleaner of claim 1, wherein a lower portion of the pipe is configured to be inserted into the first body, and an upper portion of the pipe is configured to be inserted into the second body.

3. The cleaner of claim 2, wherein the first body and the second body are slide-coupled to the pipe.

4. The cleaner of claim 3, wherein the pipe further comprises:

a main body connecting portion coupled to one or both of the first body and the second body; and a guide pipe that extends from the main body connecting portion and is configured to guide the air to the first body.

5. The cleaner of claim 4, wherein the suction unit is coupled to one or both of the first body and the second body in a direction crossing a direction in which the first body and the second body are slide-coupled to the pipe.

6. The cleaner of claim 5, wherein the suction unit is coupled to both of the first body and the second body in a state in which the first body and the second body are coupled to the pipe.

7. The cleaner of claim 5, wherein the second body includes a suction opening through which the air guided through the suction unit flows inside, and wherein, when the second body is coupled to the first body, the suction opening of the second body and the opening of the pipe are aligned.

8. The cleaner of claim 1, further comprising a sealing member that is disposed at the boundary between the first body and the second body, and wherein a portion of the sealing member is covered by the pipe, and another portion of the sealing member is exposed to an outside of the pipe.

9. The cleaner of claim 8, wherein the first body includes a seat at an inner surface of the first body, the seat being configured to support a lower end of the pipe.

10. The cleaner of claim 1, wherein the first body and the second body are arranged along a gravity direction, and the second body is disposed above the first body.

11. The cleaner of claim 1, wherein the pipe extends in a direction crossing a gravity direction and is connected to the first body and the second body.

* * * * *